US008931672B1

(12) United States Patent
Chou

(10) Patent No.: US 8,931,672 B1
(45) Date of Patent: Jan. 13, 2015

(54) SKATE BAG

(71) Applicant: Hsin-lin Chou, Fullerton, CA (US)

(72) Inventor: Hsin-lin Chou, Fullerton, CA (US)

( * ) Notice: Subject to any disclaimer, the term of this patent is extended or adjusted under 35 U.S.C. 154(b) by 0 days.

(21) Appl. No.: 14/243,607

(22) Filed: Apr. 2, 2014

(51) Int. Cl.
*A45F 3/02* (2006.01)
*B65D 85/18* (2006.01)
*A45C 3/12* (2006.01)

(52) U.S. Cl.
CPC ..... *B65D 85/187* (2013.01); *A45F 3/02* (2013.01); *A45C 3/12* (2013.01)
USPC ..... 224/584; 224/609

(58) Field of Classification Search
CPC ..... B65D 85/187; A45C 3/12; A45F 3/02
USPC ..... 224/584, 609, 600, 602, 607, 612
See application file for complete search history.

(56) References Cited

U.S. PATENT DOCUMENTS 2,672,263 A 3/1954 Alber
D204,358 S 4/1966 Rosenberg (Continued)

FOREIGN PATENT DOCUMENTS

DE 1486237 A1 * 4/1969
DE 29511754 U1 * 9/1995

*Primary Examiner* — Justin Larson
(74) *Attorney, Agent, or Firm* — QuickPatents; Kevin Prince

(57) ABSTRACT

A carrying bag for facilitating a person carrying a pair of skates or other items. The carrying bag may also be used as a cushion when empty of the skates or other items. The carrying bag may also be used to insulate items within the bag against cold environments, such as skating rinks.

Two skate compartments each include two flexible webs fixed together at portions of the peripheral edges thereof to form an internal pocket. Each web is selectively fixed together at other portions of the peripheral edges at a mechanical fastener, such as a zipper. Each flexible web substantially and mutually overlaps to form generally a skate-shaped profile that includes at least a narrow top portion and a front toe-edge portion. Preferably the selectively openable other portions of the peripheral edges are at a rear side of the bag. The narrow top portion of each compartment is mutually and opposingly fixed together at a seam area. The front toe-edge portion of each compartment terminates at a rigid preferably metallic ring, each of which may be mutually and selectively connectable with a mechanical clap, or the like.

A draw string is slidably captured by each narrow top portion of each compartment. The draw string forms a loop on the rear side of the bag, while two free ends of the drawstring terminate at a front side of the bag.

In use, with each skate placed into the pocket of one of the compartments through the open mechanical fastener, the fastener may be closed to capture the skate within the pocket of the compartment. The bag may then be carried over the person's shoulder with the two rings mutually fixed around the person's waist with the mechanical claps, or suspended from an object, such as a door knob, with the loop synched threrearound to secure the bag to the object.

In one embodiment, each flexible web includes an outer layer and an inner layer. In such an embodiment, the outer layer may be a resilient cushioning layer, and the inner layer may be made from an insulating layer of material. As such, items contained within the pocket are at least partially insulated from cold environments such as skating rinks.

In such an embodiment, a second, hidden pocket may be included between the outer layer and the inner layer, opening through the inner layer. Similarly, a third pocket may be included between the outer layer and the inner layer, opening through the outer layer.

15 Claims, 5 Drawing Sheets

(56) References Cited

U.S. PATENT DOCUMENTS

| | | | | | |
|---|---|---|---|---|---|
| D234,326 | S | | 2/1975 | Kato | |
| 4,085,873 | A | * | 4/1978 | Schweitzer | 294/142 |
| 4,126,256 | A | | 11/1978 | McGruder | |
| 4,391,396 | A | | 7/1983 | Brady | |
| 4,974,709 | A | * | 12/1990 | Furlow et al. | 190/102 |
| D339,680 | S | * | 9/1993 | Hodges, Jr. | D3/271.4 |
| D350,435 | S | | 9/1994 | Smith, IV | |
| D366,145 | S | | 1/1996 | Hankeins et al. | |
| D367,173 | S | * | 2/1996 | Trihus | D3/317 |
| 5,509,589 | A | * | 4/1996 | Kliot | 224/637 |
| 5,513,787 | A | | 5/1996 | Reed | |
| 5,564,539 | A | | 10/1996 | Duensing | |
| 5,651,486 | A | * | 7/1997 | Kliot | 224/653 |
| 5,779,036 | A | * | 7/1998 | Westbrook et al. | 206/292 |
| D400,706 | S | * | 11/1998 | Seider | D3/254 |
| D408,138 | S | | 4/1999 | Mracna | |
| 6,145,721 | A | * | 11/2000 | Gately | 224/680 |
| 6,409,385 | B1 | | 6/2002 | Gee | |
| 6,786,375 | B2 | | 9/2004 | Worden et al. | |
| D547,063 | S | | 7/2007 | Soetardjo et al. | |
| D578,763 | S | | 10/2008 | Walker | |
| D679,089 | S | | 4/2013 | Chou | |
| 2005/0035169 | A1 | | 2/2005 | Tabor et al. | |
| 2005/0274764 | A1 | * | 12/2005 | Fischel | 224/609 |
| 2007/0272570 | A1 | | 11/2007 | Brooks | |
| 2010/0147918 | A1 | * | 6/2010 | Hensley et al. | 224/600 |

* cited by examiner

SKATE BAG

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to the sport of skating, and more particularly to a skate carrying bag.

DISCUSSION OF RELATED ART

In the sport of ice skating, it is convenient to have an over-the-shoulder type carrying bag for one's ice skates when the ice skates are not being worn. The prior art includes such carrying bags, for example in U.S. Design Pat. No. D408k, 138 to Mracna on Apr. 20, 1999, and in U.S. Pat. No. 2,672, 263 to Alber on Mar. 16, 1954.

Such prior art carrying bags, however, suffer from certain drawbacks. For instance, particularly with ice skates having sharp blades, such blades can easily tear the fabric of the bag as the skates are jostled around inside the bag, such as while the carrying bag is carried on the shoulder by a person walking.

Further, such prior art products also make no provision for absorbing some of the vertical motion of the skates within the bag while carried on the shoulder by a walking person. As such, the person's shoulder can become sore due to the oscillating weight of the skates on the shoulder.

Moreover, when sitting on an often cold bench to don the skates after arriving at an ice skating rink, for example, it is desirable to have a soft and warm cushion upon which to sit. Sitting on the prior art bags, however, provides no cushioned support. Further, an internal pocket of such products are not well insulated, particularly with an external pocket as with the Alber device. It is desirable at times to shield items such as cellular phones, food items, and the like from the cold environment of a skating rink, but with the prior art products a separate insulated cooler or insulated bag would be necessary.

Further, such bags may be worn while empty to prevent theft, but with the Alber device, the prominent external pocket invites theft if the bag must be left unattended. Ideally such a bag would include provision for a hidden internal pocket.

Further, the prior art does not provide means for securing the bag to a hook, door knob or other object while not in use. Often it is convenient to hang such a bag with the skates on the back of a bedroom door, or the like, but the prior art products are prone to falling off of small objects due to their geometry.

Therefore, there is a need for a device that allows for the carrying of a pair of skates and other items that inhibits sharp ice skate blades from tearing the fabric of the carrying bag. Such a needed carrying bag would absorb much of the vertical oscillating forces of the relatively heavy ice skates within the bag while a person is walking with the carrying bag on his shoulder. Further, such a needed invention would be insulating to the contents within and would further include a soft, cushioned surface suitable for sitting upon when set on a cold bench, for example. Such a needed device would further provide for an attractive, easily adjusted draw string loop for hanging the carrying bag on an object when not in use. The present invention accomplishes these objectives.

SUMMARY OF THE INVENTION

The present device is a carrying bag for facilitating a person carrying a pair of skates or other items. The carrying bag may also be used as a cushion when empty of the skates or other items. The carrying bag may also be used to insulate items within the bag against cold environments, such as skating rinks.

Two skate compartments each include two flexible webs fixed together at portions of the peripheral edges thereof to form an internal pocket. Each web is selectively fixed together at other portions of the peripheral edges at a mechanical fastener, such as a zipper. Each flexible web substantially and mutually overlaps to form generally a skate-shaped profile that includes at least a narrow top portion and a front toe-edge portion. Preferably the selectively openable other portions of the peripheral edges are at a rear side of the bag. The narrow top portion of each compartment is mutually and opposingly fixed together at a seam area. The front toe-edge portion of each compartment terminates at a rigid preferably metallic ring, each of which may be mutually and selectively connectable with a mechanical clap, or the like.

A draw string is slidably captured by each narrow top portion of each compartment. The draw string forms a loop on the rear side of the bag, while two free ends of the drawstring terminate at a front side of the bag.

In use, with each skate placed into the pocket of one of the compartments through the open mechanical fastener, the fastener may be closed to capture the skate within the pocket of the compartment. The bag may then be carried over the person's shoulder with the two rings mutually fixed around the person's waist with the mechanical claps, or suspended from an object, such as a door knob, with the loop synched threrearound to secure the bag to the object.

In one embodiment, each flexible web includes an outer layer and an inner layer. In such an embodiment, the outer layer may be a resilient cushioning layer, and the inner layer may be made from an insulating layer of material. As such, items contained within the pocket are at least partially insulated from cold environments such as skating rinks.

In such an embodiment, a second, hidden pocket may be included between the outer layer and the inner layer, opening through the inner layer. Similarly, a third pocket may be included between the outer layer and the inner layer, opening through the outer layer.

The present invention is a device that allows for the carrying of a pair of skates and other items that inhibits sharp ice skate blades from tearing the fabric of the carrying bag. The present device can absorb much of the vertical oscillating forces of the relatively heavy ice skates within the bag while a person is walking with the carrying bag on his shoulder. Further, the present invention insulates the contents within and further includes a soft, cushioned surface suitable for sitting upon when set on a cold bench, for example. The present device provides an attractive, easily adjusted draw string loop for hanging the carrying bag on an object when not in use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
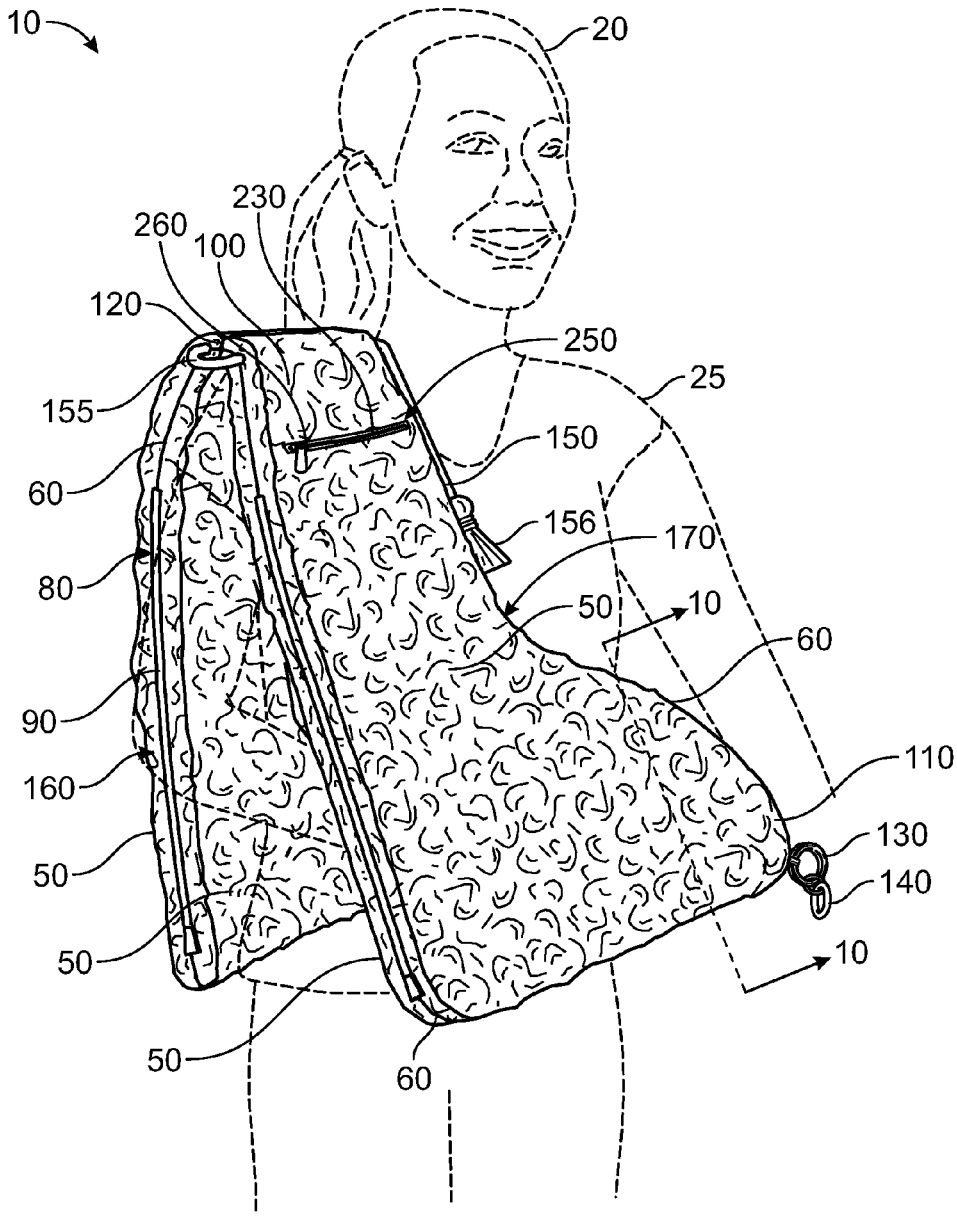
FIG. 1 is a perspective view of the invention, illustrated as worn over a person's shoulder.
Figure 2:
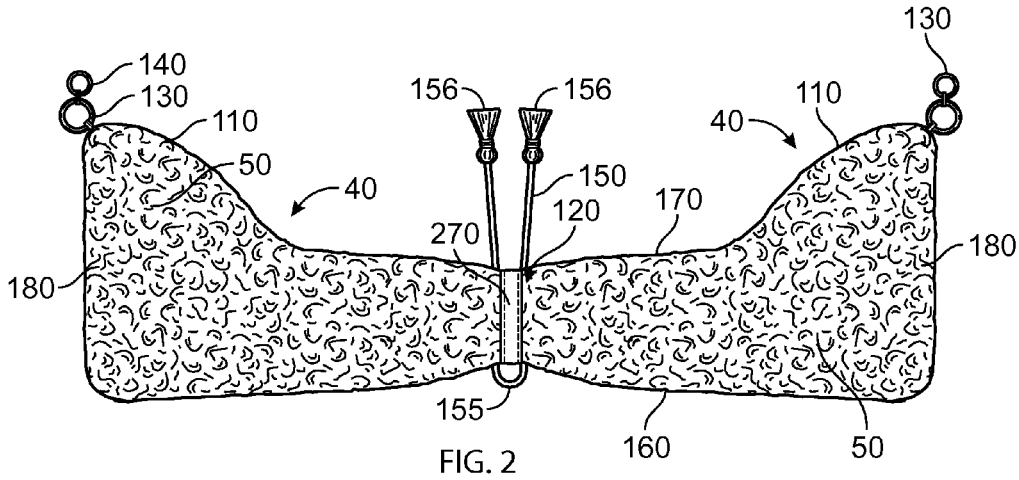
FIG. 2 is a top plan view of the invention, illustrated in a flat configuration.

FIGS. 1 and 2 illustrate a carrying bag 10 for facilitating a person 20 carrying a pair of skates 30 or other items (not shown). The carrying bag 10 may also be used as a cushion when empty of the skates 30 or other items. The carrying bag 10 may also be used to insulate items within the bag 10 against cold environments, such as skating rinks.

Figure 6:
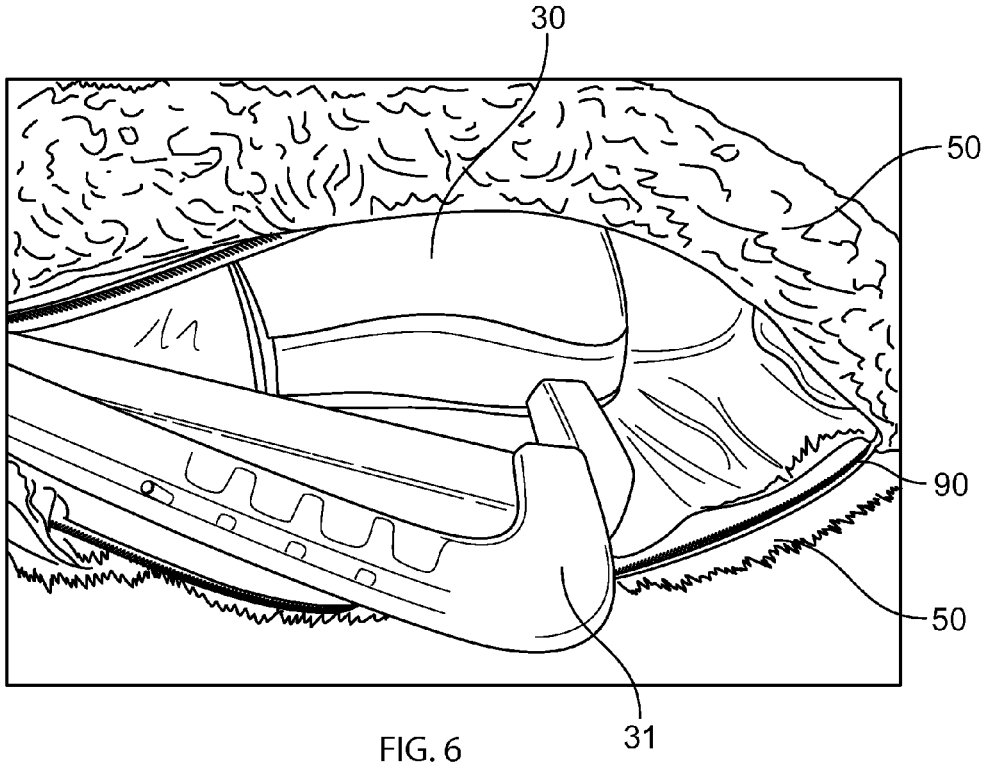
FIG. 6 is a partial perspective view of an open pocket of one compartment of the invention.
Figure 7:
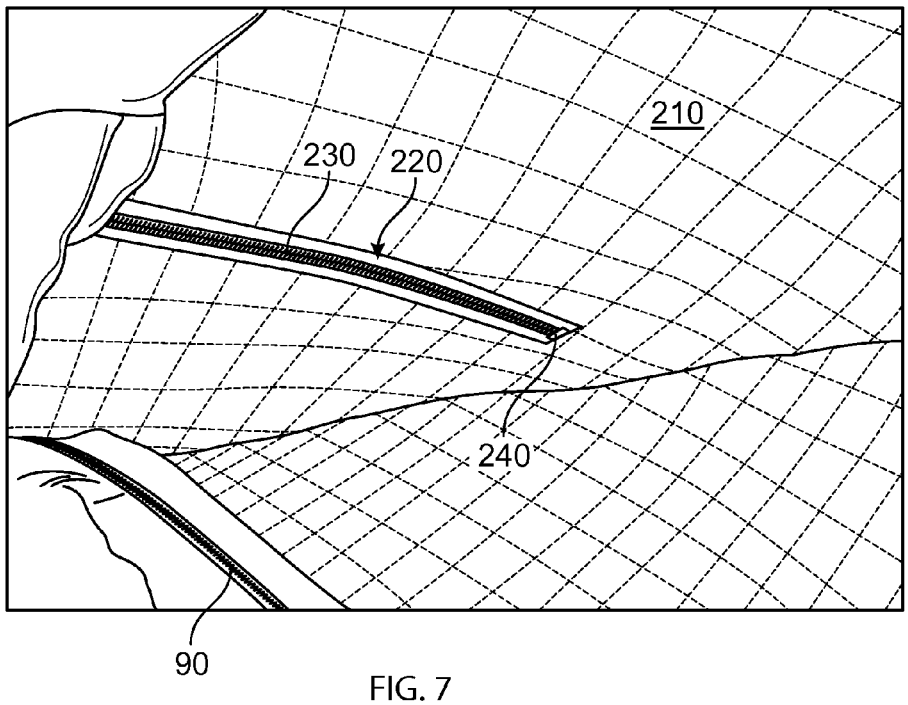
FIG. 7 is a partial perspective view of FIG. 6, further showing a second, hidden pocket formed through an inner layer of a flexible web of one of the compartments.
Figure 8:
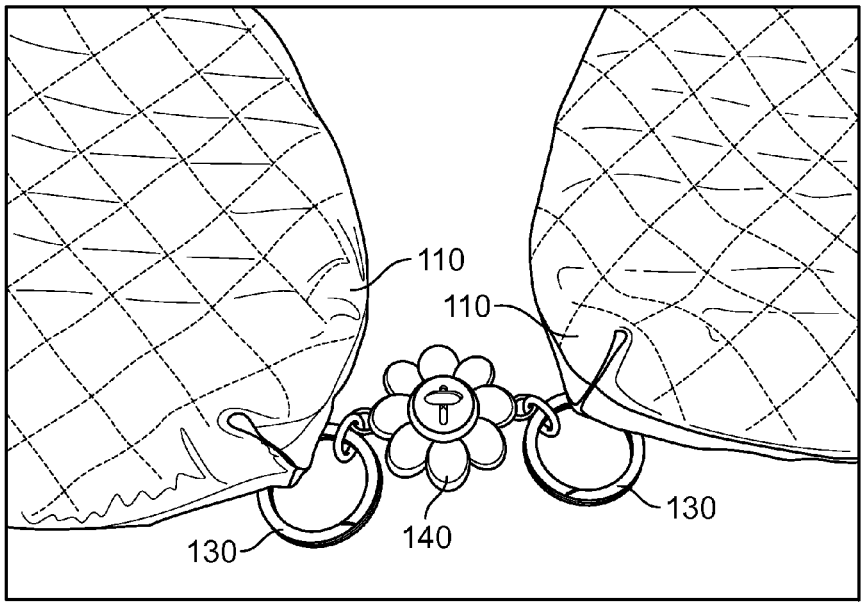
FIG. 8 is a partial perspective view of a mechanical clasp securing two rigid rings of each compartment together.
Figure 9:
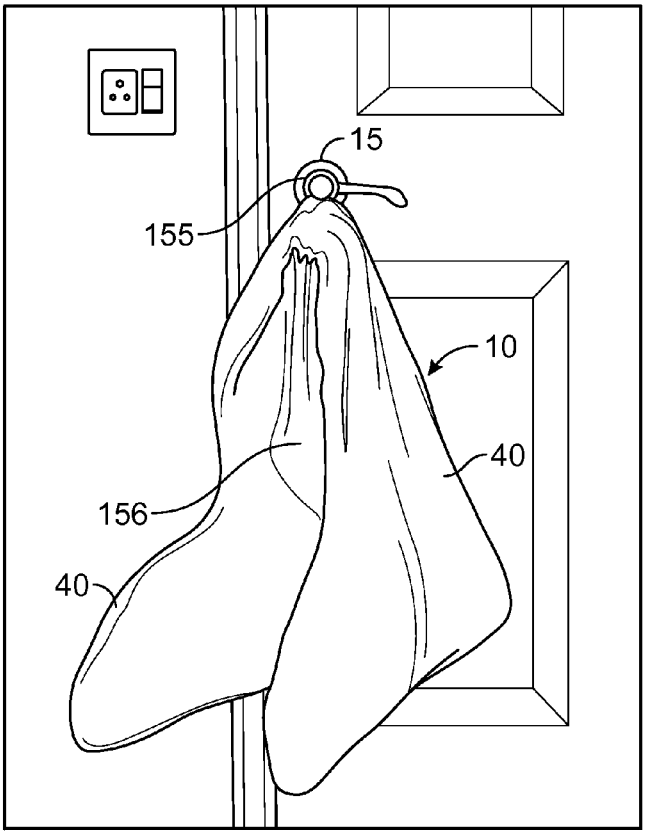
FIG. 9 is a front elevational view of the invention, illustrated as suspended by a draw string loop at a narrow top portion thereof.

A pair of skate compartments 40 each include two flexible webs 50 fixed together at portions 60 of the peripheral edges 55 thereof to form an internal pocket 70 (FIGS. 6 and 7). Each web 50 is selectively fixed together at other portions 80 of the peripheral edges 55 at a mechanical fastener 90, such as a zipper, hook-and-loop type fastener (not shown), mechanical snaps (not shown), or the like. Each flexible web 50 substantially and mutually overlaps to form generally a skate-shaped profile that includes at least a narrow top portion 100 and a front toe-edge portion 110. Preferably the selectively openable other portions 80 of the peripheral edges 55 are at a rear side 160 of the bag 10. Each flexible web 50 may be made of a resilient foam material, cushioning material, or other natural or synthetic material as appropriate.

The narrow top portion 100 of each compartment 40 is mutually and opposingly fixed together at a seam area 120. In one embodiment, the seam area 120 of the bag 10 further includes an elastic section 270 (FIG. 2) such that when the person 20 is walking with the bag 10 having the skates 30 contained therein, the force of the skates 30 when bouncing up and down is at least partially absorbed by the elastic section 270 expanding and contracting while the person 20 walks. The front toe-edge portion of each compartment 40 terminates at a rigid preferably metallic ring 130, each of which may be mutually and selectively connectable with a mechanical clap 140, or the like.

A draw string 150 is slidably captured by each narrow top portion 100 of each compartment 40. The draw string 150 forms a loop 155 on the rear side 160 of the bag 10, while two free ends 156 of the drawstring 150 terminate at a front side 170 of the bag 10. Each free end 156 is free to slide away from the bag 10 to synch the loop 155 towards the bag 10. Pulling on the loop 155 causes the free ends 156 to be pulled towards the bag 10.

In use, with each skate 30 placed into the pocket 70 of one of the compartments 40 through the open mechanical fastener 90, the fastener 90 may be closed to capture the skate 30 within the pocket 70 of the compartment 40. The bag 10 may then be carried over the person's shoulder 25 with the two rings 130 mutually fixed around the person's waist with the mechanical claps 140, or suspended from an object 15, such as a door knob, with the loop 155 synched threrearound to secure the bag 10 to the object 15.

Figure 10A:
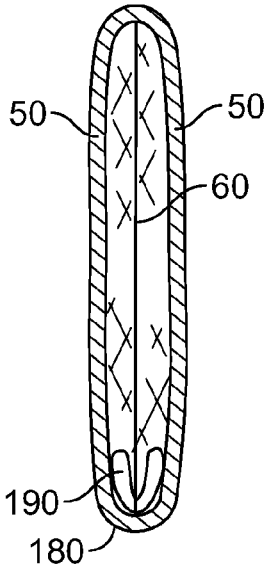
FIG. 10A is a cross-sectional view of a first embodiment of the invention, taken generally along line 10-10 of FIG. 1.

In one embodiment, a reinforcing pad 190 is fixed at a bottom portion 180 of each compartment 40 (FIG. 10A). As such, the skate 30 is inhibited from tearing through the flexible web 50 with the blade thereof (not shown).

Figure 10B:
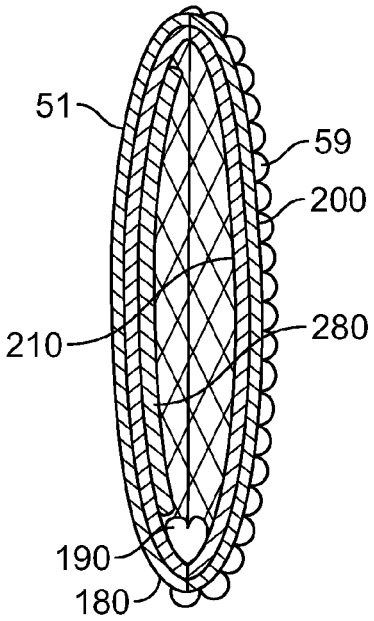
FIG. 10B is a cross-sectional view of a second embodiment of the invention, taken generally along line 10-10 of FIG. 1, illustrating each flexible web having an inner and an outer layer.
Figure 10C:
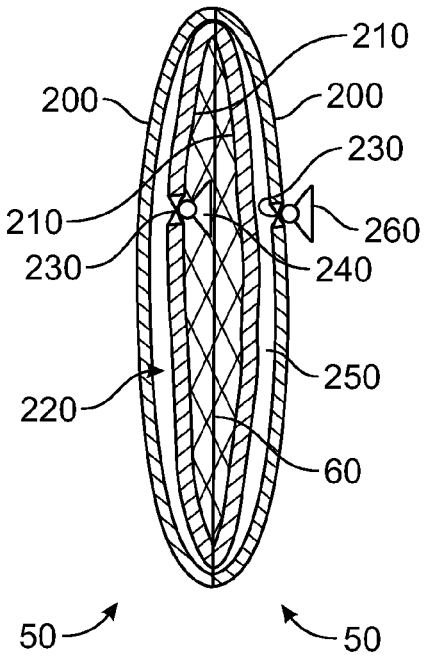
FIG. 10C is a cross-sectional view of a third embodiment of the invention, taken generally along line 10-10 of FIG. 1, illustrating each flexible web having an inner and an outer layer, and second and third pockets formed therebetween.

In one embodiment, each flexible web 50 includes an outer layer 200 and an inner layer 210 (FIGS. 10B and 10C). In such an embodiment, the outer layer 200 may be a resilient cushioning layer, made with a wool-type material, a resilient foam material, or the like. Likewise, the inner layer 210 may be made from an insulating layer of material, such as a closed-cell foam material, silk, or multiple layers of fabric, for example. As such, items contained within the pocket 70 are at least partially insulated from cold environments such as skating rinks.

In such an embodiment, a second, hidden pocket 220 (FIGS. 7 and 10C) may be included between the outer layer 200 and the inner layer 210. The second pocket 220 has an opening aperture 230 through the inner layer 210 that includes a second mechanical fastener 240, such as a zipper, for selectively opening and sealing the opening aperture 230.

Similarly, a third pocket 250 (FIGS. 1 and 10C) may be included between the outer layer 200 and the inner layer 210. The third pocket 250 has one of the opening apertures 230 through the outer layer 200 that includes a third mechanical fastener 260, such as a zipper, for selectively opening and sealing the opening aperture 230.

In one embodiment, an outermost web 59 of the two flexible webs 50 is integrally formed, as well as an innermost web 51 of the two flexible webs 50. As such, there is no seam at the top narrow portion 100 of the bag 10.

Figure 3:
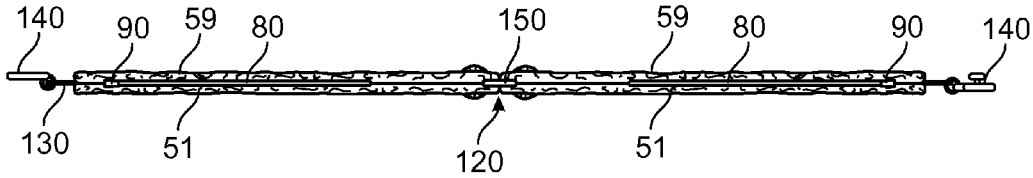
FIG. 3 is a rear elevational view of FIG. 2.
Figure 4:
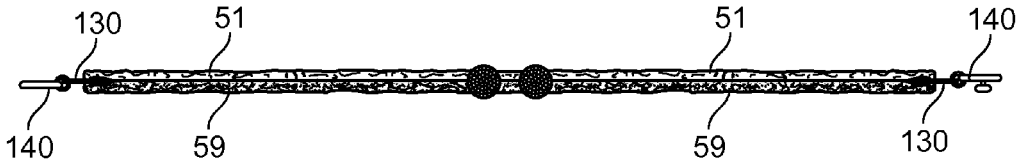
FIG. 4 is a front elevational view of an alternate embodiment of the invention, illustrated in a flat configuration.
Figure 5:
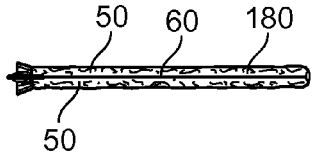
FIG. 5 is a bottom plan view of FIG. 4.

In one embodiment, each of the two flexible webs 50 of each compartment 40 are substantially identical in appearance (FIG. 3), such that the carrying bag 10 may be worn with either of the outermost web 59 or the innermost web 51 facing away from the person 20 without changing the overall appearance of the carrying bag 10. As such, the person 20 may grab the carrying bag and place it over his shoulder 25 without regard to which side of the bag is facing outward. Alternately, each of the two flexible webs 50 of each compartment 40 may have a contrasting appearance (FIG. 4), so that with the outermost web 59 facing out the person 20 is afforded a first appearance, and with the innermost web 51 facing out the person 20 is afforded a contrasting, second appearance. For example, the innermost web 51 may be shaded a different color than the outermost web 59. Alternately, a sports logo (not shown) may be included on the outermost web 59 but not on the innermost web 51. Any number of contrasting looks may be accomplished by alternating the appearance of the innermost web 51 from the outermost web 59.

In one embodiment, the innermost web 51 may further include an additional padding layer 280 of a resilient foam or cushioning material (FIG. 10B). As such, the weight of the skates 30 or other items within the pocket 70 are cushioned against the person 20 when the carrying bag 10 is worn over the person's shoulders 25.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A carrying bag for facilitating a person carrying a pair of skates, comprising:

a pair of skate compartments each including two flexible webs fixed together at portions of the peripheral edges thereof to form an internal pocket, and selectively fixed together at other portions of the peripheral edges at a mechanical fastener, each flexible web substantially completely overlapping in a skate shape profile that includes at least a narrow top portion and a front toe-edge portion, the narrow top portion of each compartment mutually and opposingly fixed together at a seam area, the front toe-edge portion of each compartment terminating at a rigid ring, each ring mutually and selectively connectable with a mechanical clasp; and a draw string slidably captured by each narrow top portion of each compartment and forming a loop on a rear side of the bag and two free ends on a front side of the bag, each free end being slidable away from the bag to synch the loop against the bag;

whereby each skate may be placed into one of the compartments through the open mechanical fastener, and the fastener closed to capture the skate within the pocket of the compartment, the bag being either carried over the person's shoulder with the two rings mutually fixed around the person's waist with the mechanical clasp, or suspended from an object with the loop synched thereabout to secure the bag to the object.

2. The carrying bag of claim 1 wherein the mechanical fastener is positioned at the rear side of each compartment.

3. The carrying bag of claim 1 wherein each compartment includes a reinforcing pad at a bottom portion of the compartment.

4. The carrying bag of claim 1 wherein each flexible web includes an outer layer and an inner layer.

5. The carrying bag of claim 4 wherein the outer layer is a resilient cushioning layer and the inner layer is an inner insulating layer.

6. The carrying bag of claim 4 wherein a second, hidden pocket is included between the outer and inner layers, the second, hidden pocket having an opening aperture through the inner layer that includes a second mechanical fastener for selectively opening and sealing the opening aperture.

7. The carrying bag of claim 4 wherein a third pocket is included between the outer and inner layers, the third pocket having an opening aperture through the outer layer that includes a third mechanical fastener for selectively opening and sealing the opening aperture.

8. The carrying bag of claim 1 wherein the seam area of the bag further includes an elastic section, whereby when the person is walking with the bag having skates contained therein, the force of the skates when bouncing up and down is at least partially absorbed by the elastic section.

9. The carrying bag of claim 1 wherein an outermost of the two flexible webs of each compartment is integrally formed, and wherein an innermost of the two flexible webs of each compartment is integrally formed.

10. The carrying bag of claim 1 wherein each of the two flexible webs of each compartment are substantially identical in appearance, whereby the carrying bag may be worn with either of the flexible webs facing away from the person without changing the overall appearance of the carrying bag.

11. The carrying bag of claim 1 wherein each of the two flexible webs of each compartment contrast in appearance, whereby the carrying bag may be worn with one of the flexible webs facing away from the person for a first appearance, and with the second of the flexible webs facing away from the person for a contrasting second appearance.

12. The carrying bag of claim 11 wherein the first of each of the flexible webs includes an additional padding layer to cushion the weight of the skates against the person when the carrying bag is worn over the person's shoulders.

13. The carrying bag of claim 1 wherein the mechanical fastener is a zipper.

14. The carrying bag of claim 6 wherein the second mechanical fastener is a zipper.

15. The carrying bag of claim 7 wherein the third mechanical fastener is a zipper.

* * * * *